US010910710B2

(12) United States Patent
Ling et al.

(10) Patent No.: US 10,910,710 B2
(45) Date of Patent: Feb. 2, 2021

(54) METHODS AND SYSTEMS FOR DISTORTION REDIRECTION IN PHASED ARRAYS

(71) Applicant: MaxLinear, Inc., Carlsbad, CA (US)

(72) Inventors: Curtis Ling, Carlsbad, CA (US); Sridhar Ramesh, Carlsbad, CA (US)

(73) Assignee: MaxLinear, Inc., Carlsbad, CA (US)

( * ) Notice: Subject to any disclaimer, the term of this patent is extended or adjusted under 35 U.S.C. 154(b) by 158 days.

(21) Appl. No.: 16/194,320

(22) Filed: Nov. 17, 2018

(65) Prior Publication Data

US 2019/0157756 A1 May 23, 2019

Related U.S. Application Data

(60) Provisional application No. 62/587,992, filed on Nov. 17, 2017.

(51) Int. Cl.

| | |
|---|---|
| ***H01Q 3/40*** | (2006.01) |
| ***H01Q 3/26*** | (2006.01) |
| ***H01Q 21/00*** | (2006.01) |
| ***H01Q 3/42*** | (2006.01) |
| ***H01Q 21/06*** | (2006.01) |

(52) U.S. Cl.

CPC ..... *H01Q 3/2647* (2013.01); *H01Q 3/2658* (2013.01); *H01Q 3/40* (2013.01); *H01Q 3/42* (2013.01); *H01Q 21/0025* (2013.01); *H01Q 21/064* (2013.01)

(58) Field of Classification Search

CPC .... H01Q 1/288; H01Q 3/2647; H01Q 3/2652; H01Q 3/2658; H01Q 3/40; H01Q 3/42; H01Q 3/46; H01Q 21/0025; H01Q 21/064

USPC ..... 342/370

See application file for complete search history.

(56) References Cited

U.S. PATENT DOCUMENTS

| | | | | |
|---|---|---|---|---|
| 2012/0220238 | A1* | 8/2012 | Hosoya | H04B 17/373 455/63.4 |
| 2018/0288232 | A1* | 10/2018 | MacNeille | H04M 11/007 |
| 2019/0013580 | A1* | 1/2019 | Vigano | H01Q 3/40 |
| 2019/0238204 | A1* | 8/2019 | Kim | H04L 27/367 |

* cited by examiner

*Primary Examiner* — Harry K Liu

(74) *Attorney, Agent, or Firm* — Maschoff Brennan

(57) ABSTRACT

Systems and methods are provided for distortion redirection in phased arrays. In an electronic device configured for transmission and reception of signals and having a two-dimensional phased array, effects of distortion, corresponding to at least one processing function applied during communication of signals, on the communication of signals may be assessed, and based on the effects of distortion, one or more adjustments for mitigating the effects of distortion may be configured and applied during processing of signals. Assessing the effects of distortion may include determining one or more characteristics associated with the communication of the signals, where the one or more characteristics relate and/or are subject to the effects of the distortion, and assessing the effects of distortion based on the one or more characteristics.

20 Claims, 8 Drawing Sheets

700

METHODS AND SYSTEMS FOR DISTORTION REDIRECTION IN PHASED ARRAYS

CLAIM OF PRIORITY

This patent application makes reference to, claims priority to and claims benefit from U.S. Provisional Patent Application Ser. No. 62/587,992, filed on Nov. 17, 2017. The above identified application is hereby incorporated herein by reference in its entirety.

TECHNICAL FIELD

Aspects of the present disclosure relate to communication solutions. More specifically, certain implementations of the present disclosure relate to methods and systems for distortion redirection in phased arrays.

BACKGROUND

Various issues may exist with conventional approaches for implementing cable networks, particularly coaxial cable based networks. In this regard, conventional systems and methods, if any existed, for designing and implementing coaxial cable plants, can be costly, inefficient, and/or ineffective.

Further limitations and disadvantages of conventional and traditional approaches will become apparent to one of skill in the art, through comparison of such systems with some aspects of the present disclosure as set forth in the remainder of the present application with reference to the drawings.

BRIEF SUMMARY

System and methods are provided for a methods and systems for distortion redirection in phased arrays, substantially as shown in and/or described in connection with at least one of the figures, as set forth more completely in the claims.

These and other advantages, aspects and novel features of the present disclosure, as well as details of an illustrated embodiment thereof, will be more fully understood from the following description and drawings.

DETAILED DESCRIPTION

Figure 1A:
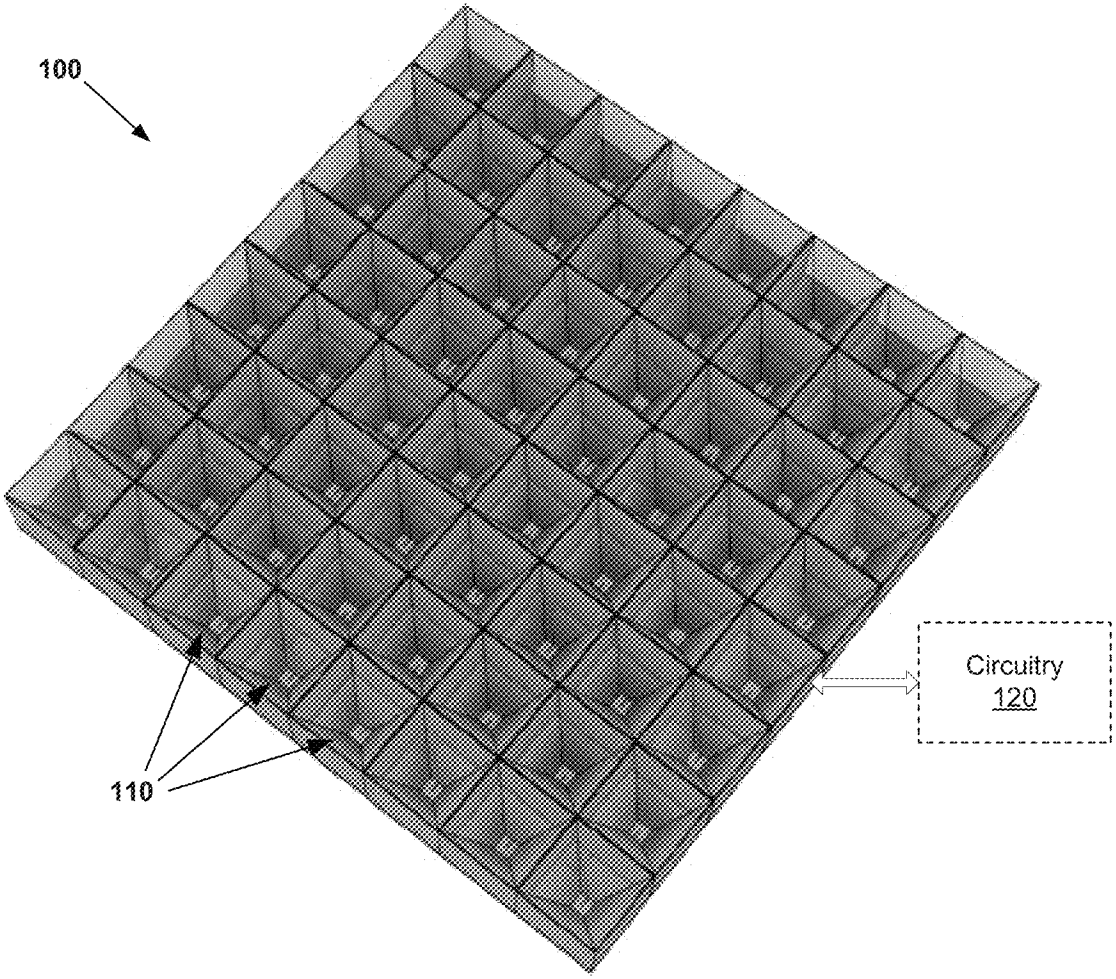
FIGS. 1A and 1B illustrate an example phased array based system.

As utilized herein the terms "circuits" and "circuitry" refer to physical electronic components (e.g., hardware), and any software and/or firmware ("code") that may configure the hardware, be executed by the hardware, and or otherwise be associated with the hardware. As used herein, for example, a particular processor and memory (e.g., a volatile or non-volatile memory device, a general computer-readable medium, etc.) may comprise a first "circuit" when executing a first one or more lines of code and may comprise a second "circuit" when executing a second one or more lines of code. Additionally, a circuit may comprise analog and/or digital circuitry. Such circuitry may, for example, operate on analog and/or digital signals. It should be understood that a circuit may be in a single device or chip, on a single motherboard, in a single chassis, in a plurality of enclosures at a single geographical location, in a plurality of enclosures distributed over a plurality of geographical locations, etc. Similarly, the term "module" may, for example, refer to a physical electronic components (e.g., hardware) and any software and/or firmware ("code") that may configure the hardware, be executed by the hardware, and or otherwise be associated with the hardware.

As utilized herein, circuitry or module is "operable" to perform a function whenever the circuitry or module comprises the necessary hardware and code (if any is necessary) to perform the function, regardless of whether performance of the function is disabled or not enabled (e.g., by a user-configurable setting, factory trim, etc.).

As utilized herein, "and/or" means any one or more of the items in the list joined by "and/or". As an example, "x and/or y" means any element of the three-element set {(x), (y), (x, y)}. In other words, "x and/or y" means "one or both of x and y." As another example, "x, y, and/or z" means any element of the seven-element set {(x), (y), (z), (x, y), (x, z), (y, z), (x, y, z)}. In other words, "x, y and/or z" means "one or more of x, y, and z." As utilized herein, the term "exemplary" means serving as a non-limiting example, instance, or illustration. As utilized herein, the terms "for example" and "e.g." set off lists of one or more non-limiting examples, instances, or illustrations.

An example method in accordance with the present disclosure, which may be performed in an electronic device configured for transmission and reception of signals, may comprise assessing effects of distortion, corresponding to at least one processing function applied during communication of signals, on the communication of signals, configuring based on the effects of distortion, one or more adjustments for mitigating the effects of distortion, and applying the one or more adjustments during processing of signals. In this regard, assessing effects of the distortion may comprise determining one or more characteristics associated with the communication of the signals, where the one or more characteristics relate and/or are subject to the effects of the distortion, and assessing the effects of distortion based on the one or more characteristics.

In an example implementation, the at least one processing function may comprise power amplification applied during transmission of signals.

In an example implementation, the one or more characteristics may comprise directionality of signals.

In an example implementation, assessing the effects of distortion based on the one or more characteristics may comprise determining directionality of interference caused by the distortion in relation to the directionality of signals. Further, configuring the one or more adjustments may comprise setting or modifying at least one adjustment to adjust the directionality of interference.

In an example implementation, the communication of signals may comprise use of a plurality of antenna elements, and configuring the one or more adjustments may comprise adaptively setting or modifying at least one adjustment applicable to each antenna element in the plurality of antenna elements.

In an example implementation, the one or more adjustments may be configured based on one or more performance criteria.

In an example implementation, the one or more performance criteria may comprise enhancing security of the communication of signals, and configuring the one or more adjustments may comprise setting or modifying at least one adjustment to reduce detectability of the communication of signals.

In an example implementation, the one or more performance criteria may comprise effects on adjacent systems or devices, and configuring the one or more adjustments may comprise setting or modifying at least one adjustment to spatially spread interference caused by the distortion.

In an example implementation, configuring and/or applying the one or more adjustments may be performed in conjunction with one or more other distortion mitigating measures, with the one or more other distortion mitigating measures comprising digital pre-distortion (DPD) based functions.

An example system in accordance with the present disclosure may comprise a plurality of antenna elements arranged in two-dimensional array, and a plurality of transmitter circuits, with each transmitter circuit configured for handling transmission of signals via a corresponding antenna element in the plurality of antenna elements. Each transmitter circuit may comprise a distortion control circuit and one or more adjustment circuits. The distortion circuit may be configured to assess effects of distortion, corresponding to at least one processing function applied via a processing circuit in transmitter circuit during processing of signals, on communication of signals, and to configure based on the effects of distortion, one or more adjustments for mitigating the effects of distortion. In this regard, assessing the effects of distortion may comprise determining one or more characteristics associated with the communication of the signals, with the one or more characteristics relating to and/or being subject to the effects of the distortion, and assessing the effects of distortion based on the one or more characteristics. The one or more adjustment circuits may be configured for applying the one or more adjustments during the processing of signals via the transmitter circuit.

In an example implementation, the processing circuit may comprise a power amplifier.

In an example implementation, the one or more adjustment circuits may comprise adders, with each adder being configured to add at least one adjustment to a corresponding intermediate signal within the transmitter circuit during processing of the signals.

In an example implementation, the one or more characteristics may comprise directionality of signals, and the distortion control circuit may be configured for determining directionality of interference caused by the distortion in relation to the directionality of signals.

In an example implementation, the distortion control circuit may set or modify at least one adjustment to adjust the directionality of interference.

In an example implementation, the distortion control circuit may be configured to adaptively set or modify at least one adjustment based on the corresponding antenna element in the plurality of antenna elements.

In an example implementation, the distortion control circuit may configure the one or more adjustments based on one or more performance criteria.

In an example implementation, the one or more performance criteria may comprise enhancing security of the communication of signals, and the distortion control circuit may set or modify at least one adjustment to reduce detectability of the communication of signals.

In an example implementation, the one or more performance criteria may comprise effects on adjacent systems or devices, and the distortion control circuit may set or modify at least one adjustment to spatially spread interference caused by the distortion.

In an example implementation, the transmitter circuit may comprise a digital pre-distortion (DPD) circuit configured for applying digital pre-distortion (DPD) based adjustments in conjunction with the one or more adjustments.

Figure 1B:
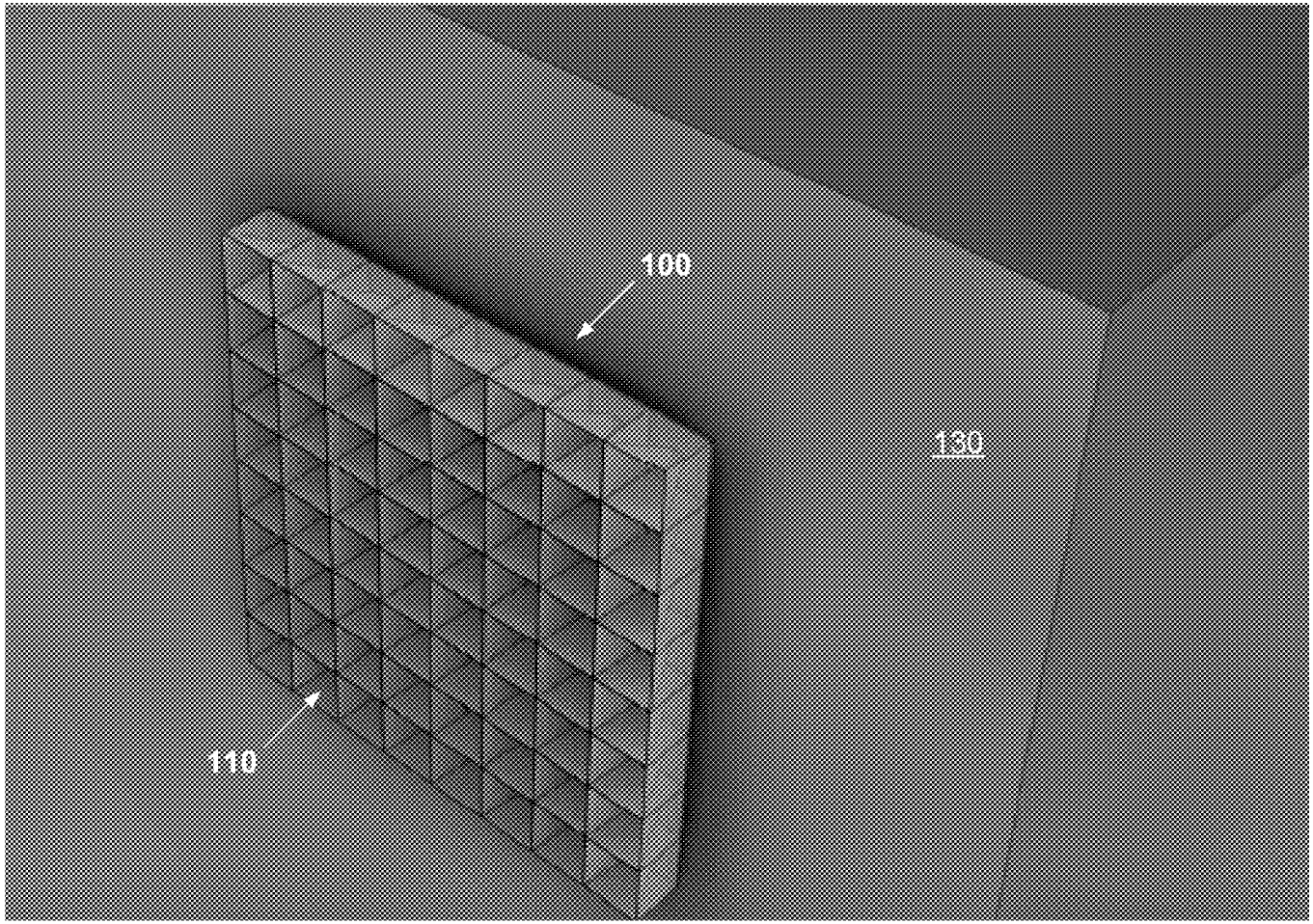

FIGS. 1A and 1B illustrate an example phased array based system. Shown in FIGS. 1A and 1B is an example phased array based system 100.

The phased array based system 100 may be designed and/or implemented based on use of beamforming via an array of antenna elements. In this regard, rather than use of a single dish, a number of antenna elements, arranged in a 2-dimensional array, may be used to transmit and receive signals. The transmission and reception of signals may be done using beamforming, which may be particularly configured for addressing possible issues (interference, etc.) and/or to provide added features, as described below. The phased array based system 100 may be configured to utilize digital signals, which may allow for use of minimal circuitry.

As shown in FIG. 1, the phased array based system 100 may comprise an array of antenna elements 110 (e.g., 64 elements, in 8×8 arrangement, as shown in the non-limiting example implementation illustrated in FIG. 1) and circuitry 120 for handling and/or supporting transmission and reception of signals via the array of antenna elements 110. In this regard, the circuity 120 may comprise suitable circuits for performing various signal processing related functions, as well as (optionally) other functions (e.g., control, storage, etc.) utilized for facilitating the transmission and reception of signals via the antenna elements 110. The circuitry 120 (or at least a portion thereof) may implemented as chip-based (e.g., system on chip (SoC), printed circuit board (PCB), etc.) circuitry incorporated into the antenna array architecture itself.

Phased array based systems, such as the phased array based system 100, offer various advantages and/or improvements over conventional antenna systems, such as dish-based designs. In this regard, because of their light weight, small form factor, and use of beam steering (e.g., beamforming), phased array based systems are preferable over traditional dish-based designs. The elimination of dish and related components (e.g., the frequency duplexer, large power amplifier ("PA"), etc.) allows for installation at a wider range of sites, with lower cost of installation and operation (e.g., automatic alignment). Accordingly, phased array based systems may be installed in a more flexible manner compared to dish-based designs, allowing installation options not possible or practical with traditional designs—e.g., mounting to sides of buildings, etc. This is shown in FIG. 1B, with the phased array based system 100 installed on a side wall of a building 130.

Phased array based systems may have lower costs (e.g., fewer, smaller, and less expensive circuits, etc.). Also, the use of software-defined multiband array operation adds more flexibility. For example, the elimination of certain components (e.g., duplexers) allows the array-based systems to operate across a wide frequency range. Greater link reach may be achieved for the same dish size (due to, e.g., greater transmitter power, interference suppression, etc.). Operations may be improved (e.g., lower operating expenditures, greater frequency reuse, lower weight, etc.). Further, phased array based systems may have superior thermal dissipation characteristics. In addition, the same core technology may be utilized for different interfaces and/or frequencies bands, allowing for common software and hardware development.

However, some issues may arise with phased arrays and use thereof. For example, one of the issues with phased arrays is the potential distortion caused by certain components, such as power amplifiers. In this regard, power amplifiers typically may be the last circuit and/or processing step in a signal chain, and as such functions (e.g., characteristics thereof) of the power amplifiers may have important effects on the transmission of signals and quality thereof. For example, one such effect is the distortion that may be introduced by the power amplifiers during transmission of signals, such as because of certain characteristics (e.g., nonlinearity) in the power amplifiers. This may particularly be troublesome because power amplifier distortion in conventional phased arrays is co-directional with desired signal. Thus, addressing PA distortion may be desirable for improving performance in phased array based systems.

Accordingly, in various implementations in accordance with the present disclosure, phased array based systems may be configured to incorporate measures for mitigating PA distortion. For example, these measures may be configured to direct PA distortion in a different direction from desired signal. For example, the PA distortion for all antenna elements may be directed in one direction different than the desired signals, or in different directions. Such redirecting of PA distortion may result in substantial improvement to spectral purity at the desired receiver.

In various implementations, distortion may be directed in a controlled fashion and may be spread out spatially as desired. The spatial distribution of distortion may be adaptively controlled, such as to conform to required radiation pattern envelopes (e.g., regulatory based radiation pattern, such as FCC mandated radiation patterns). In an example implementation, a distortion vector may be variably rotated, with the rotation being continually changed based on some criteria, such as based on the antenna elements (e.g., the rotation change being implemented as a function of antenna index i which is used to uniquely identify each antenna element in the phased array). For example, rotation may be changed by introduction of an additional distortion vector, or other techniques. This is described in more detail below.

Figure 2:
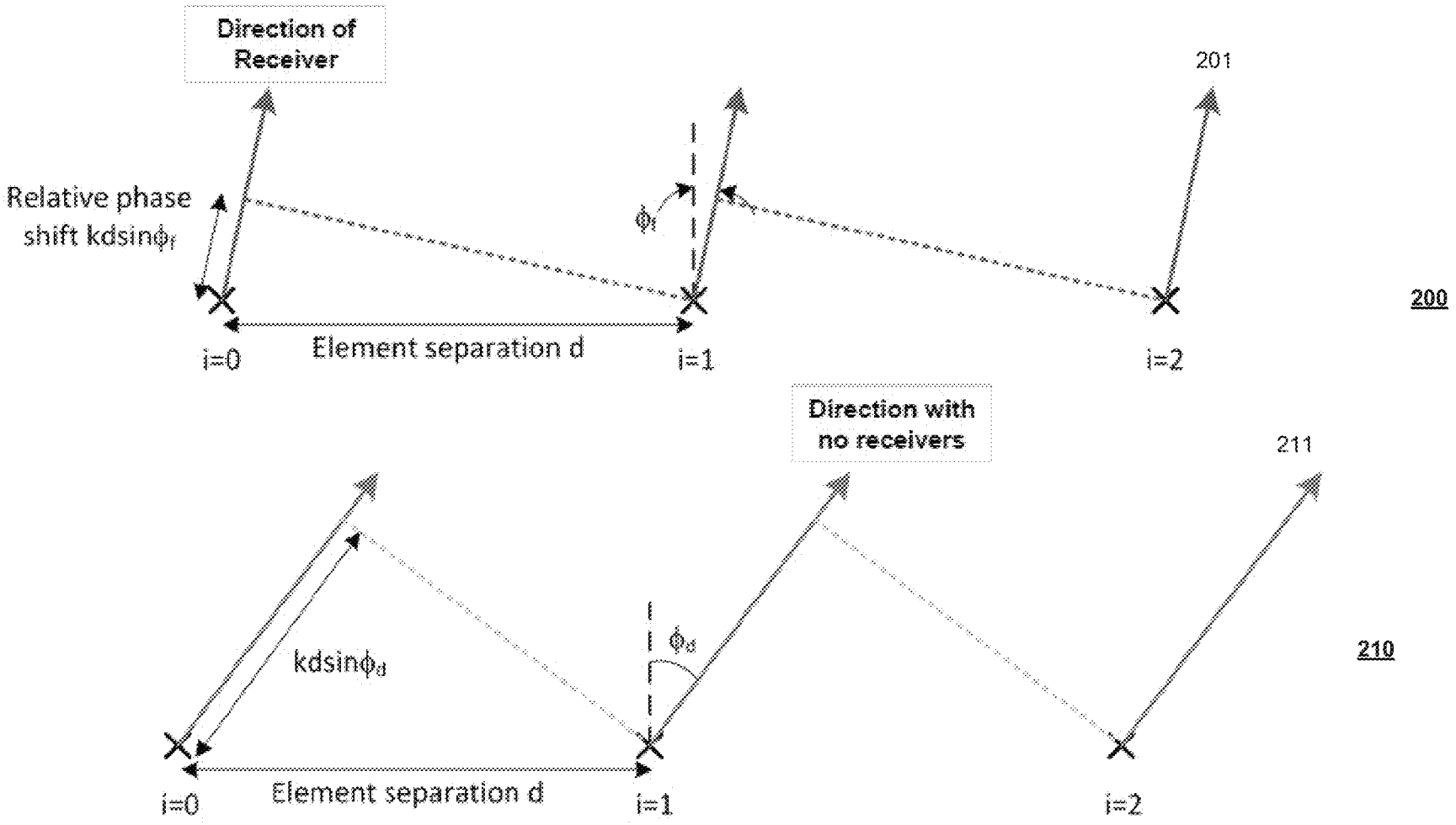
FIG. 2 illustrates effects of distortion redirection on transmissions of different elements of a phased array.

FIG. 2 illustrates effects of distortion redirection on transmissions of different elements of a phased array. Shown in FIG. 2 are charts 200 and 210, corresponding respectively to the desired signals emitted by antenna elements in a phased array and to distortions (e.g., PA distortions) emitted by these antenna elements.

Shown in chart 200 are desired (fundamental) signals $\mathbf{201}_i$ of three antenna elements (each identified by its unique antenna index: i=0, i=1, and i=2). These antenna elements are separated by a constant element separation d (distance between each adjacent elements). The fundamental signals $\mathbf{201}_i$ may be configured to project—that is, have their power add coherently—in a particular direction (e.g., $\phi_f$). This may be done by introducing a phase shift (e.g., kd sin $\phi_f$) at each antenna element relative to the previous antenna element.

Shown in chart 210 are distortion vectors $\mathbf{211}_i$ corresponding to the same three antenna elements noted with the respect to chart 200—that is, the antenna elements identified by antenna indexes: i=0, i=1, and i=2. These fundamental signals $\mathbf{211}_i$ may project in particular direction (e.g., $\phi_d$), resulting from a corresponding phase shift (e.g., kd sin $\phi_d$) at each antenna element.

In an example implementation, the distortion may be spread in different directions by applying an adjustment to shift the distortion. For example, the distortions may be projected in different directions by applying adjustment in an adaptive manner to rotate the distortion, such as based on the corresponding antenna index. This is explained in more detail with respect to FIG. 3.

Figure 3:
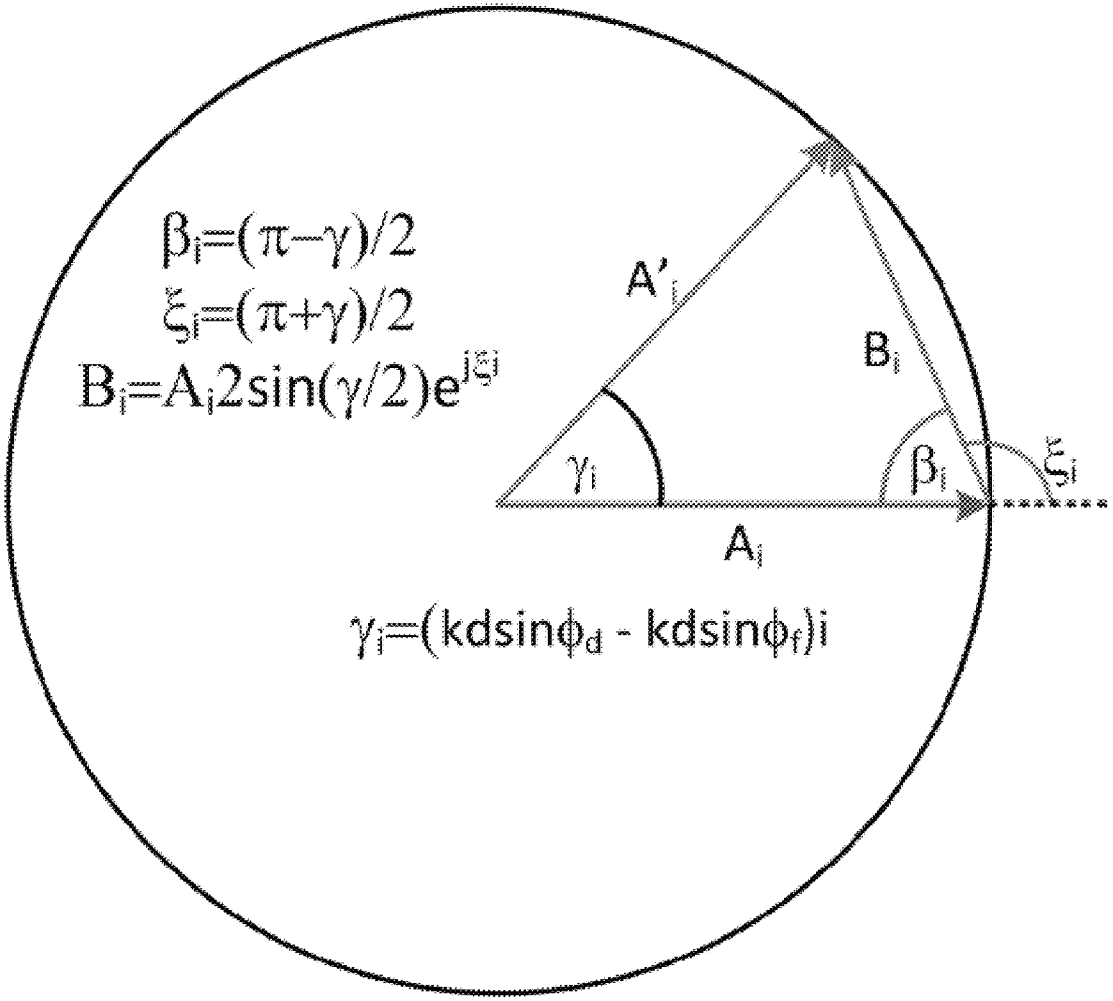
FIG. 3 illustrates example approach for implementing distortion redirection in a phased array.

FIG. 3 illustrates example approach for implementing distortion redirection in a phased array. As shown in FIG. 3, distortion vectors may be adjusted to spread distortion, with the adjustment being calculated in an adaptive manner, particularly based on an antenna index of the corresponding antenna element. In particular, the distortion vectors may be rotated as a function of antenna index.

For example, assuming vector $A_i$ shown in FIG. 3 represents the distortion vector (i being the antenna index of the antenna element, as described with respect to FIG. 2), vector $A_i'$ represents the redirected distortion. The redirecting may be achieved by computing and applying an additional angular rotation per antenna element, resulting in the vector $A_i'$ rotating at a different rate than the vector $A_i$.

In an example implementation, this distortion redirection may be done by computing and applying an adjustment vector $B_i$ to rotate distortion (e.g., by $\gamma_i$) at a different rate as a function of the antenna index. In this regard, the $B_i$ may be computed such that the distortion rotation angle $\gamma_i$ is function of the value of antenna index i—e.g., by adjusting $\gamma_i$ based on the antenna index i. For example, with reference to the scenario described in FIG. 2, the rotation angle $\gamma_i$ and the corresponding adjustment vector $B_i$ (which must be applied to achieve that rotation angle) may be computed as:

$$\gamma_i=(kd \sin \phi_d-kd \sin \phi_f)*i \quad \text{(Eq. 1)}$$

$$B_i=A_i*2 \sin(\gamma_i/2)e^{j\xi i} \quad \text{(Eq. 2)}$$

Accordingly, use of distortion redirection in accordance with various implementations of the present disclosure has many advantages and provides many improvement over existing solutions. For example, distortion redirection in accordance with the present disclosure does not require precise modeling, or tracking of the power amplifiers. In this regard, the rotation technique used in conjunction with the present disclosure is robust (e.g., +/−30% or more) with respect to model inaccuracies and drift. Additionally, other distortion mitigation measures (e.g., digital pre-distortion (DPD) techniques) typically require a feedback path. The rotation technique of the present disclosure does not require a feedback path to track the power amplifiers.

The distortion redirection may also allow for spreading distortion spatially to further reduce its potential impact. For example, a redirection angle can be changed per symbol. Also, the redirection angle can be chosen to be innocuous—e.g., pointed where no other users reside (at the sky, for example). The distortion redirection may be done such that the distortion is directed in a manner that enhances security (e.g., toward sidelobes). Improvements may be obtained from use of distortion redirection even under particularly adverse conditions (e.g., hard clipping) where other distortion related techniques (e.g., DPD) may not be effective. The distortion redirection may be combined with open-loop or feedback-based DPD for further performance gains.

Figure 4:
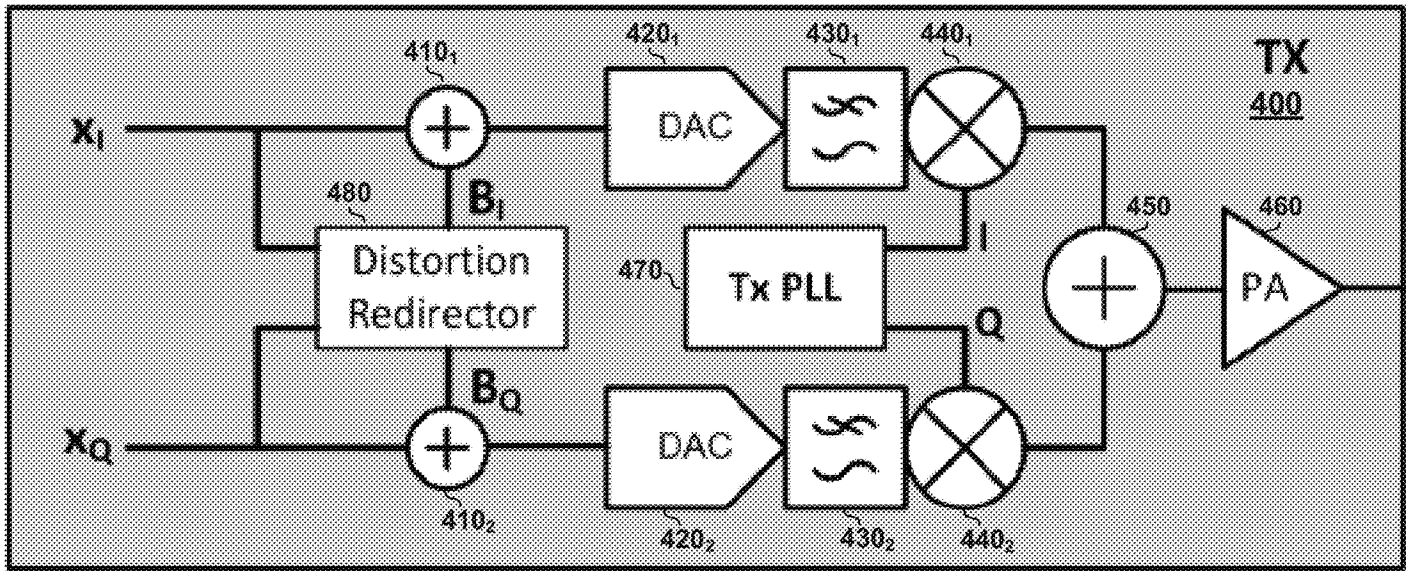
FIG. 4 illustrates an example transmitter that may support distortion redirection, for use in a phased array based system.

FIG. 4 illustrates an example transmitter that may support distortion redirection, for use in a phased array based system. Shown in FIG. 4 is an example transmitter circuit 400.

The transmitter circuit 400 may comprise suitable circuitry for handling processing of signals transmitted via an antenna element in a phased array. In this regard, the transmitter circuit 400 may be configured for supporting use of distortion redirection, as described above.

As shown in example implementation illustrated in FIG. 4, the transmitter circuit 400 may comprise a pair of adders $\mathbf{410}_1$ and $\mathbf{410}_2$, a pair of digital-to-analog converters (DACs) $\mathbf{420}_1$ and $\mathbf{420}_2$, a pair of filters $\mathbf{430}_1$ and $\mathbf{430}_2$, a pair of mixers $\mathbf{440}_1$ and $\mathbf{440}_2$, an adder 450, and a power amplifier (PA) 460. In this regard, the transmitter circuit 400 may be arranged for processing each of two digital inputs (shown as $X_I$ and $X_Q$ in FIG. 4) corresponding to the in-phase and quadrature components (I/O components) of the input signals—that is, the signals being transmitted via the corresponding antenna element.

For example, the adder $\mathbf{410}_1$, the DAC $\mathbf{420}_1$, the filter $\mathbf{430}_1$, and the mixer $\mathbf{440}_1$ are be configured for processing the in-phase component of the input signals (an I-component processing path); whereas the adder $\mathbf{410}_2$, the DAC $\mathbf{420}_2$, the filter $\mathbf{430}_2$, and the mixer $\mathbf{440}_2$ are be used in processing the quadrature components (Q component) of the input signals (an Q-component processing path). The outputs of the I-component processing path and the Q-component processing path (corresponding to outputs of the mixers $\mathbf{440}_1$ and $\mathbf{440}_2$) may be added via adder 450, and the result may then be amplified via the PA 460.

The transmitter circuit 400 may also comprise a transmit phase-locked loop (PLL) 470 for providing shared timing (periodic) signals. In this regard, the PLL 470 may generate different timing signals corresponding to the I/O components, which may be applied to the I-component processing path and the Q-component processing path via the mixers $\mathbf{440}_1$ and $\mathbf{440}_2$.

Further, the transmitter circuit 400 may comprise a distortion redirector 480, which may comprise suitable circuitry for determining distortion redirection adjustments, and may generate control signals for making these adjustments. For example, the distortion redirector 480 receives copies of the input signal (e.g., the I-component and Q-component, shown as $X_I$ and $X_Q$) and computes based thereon corresponding adjustments to redirect distortion in an adaptive manner.

For example, the distortion redirector 480 may be configured to compute adjustment vectors $B_i$ (and corresponding components $B_I$ and $B_Q$, configured for application to each of the I-component and Q-component, respectively) that need to be added to fundamental signals as described with respect to FIG. 3, above, to redirect distortion by rotating the anticipated distortion vector as a function of the corresponding antenna element (antenna index). The computed adjustments may be applied to the I-component processing path and the Q-component processing path, via the adders $\mathbf{410}_1$ and $\mathbf{410}_2$.

The approach exemplified in this implementation has the benefit of being robust with respect to the power amplifier distortion model and variations thereof. Further, it requires no feedback as it performs the computation based on the desired signals rather than the PA.

Figure 5:
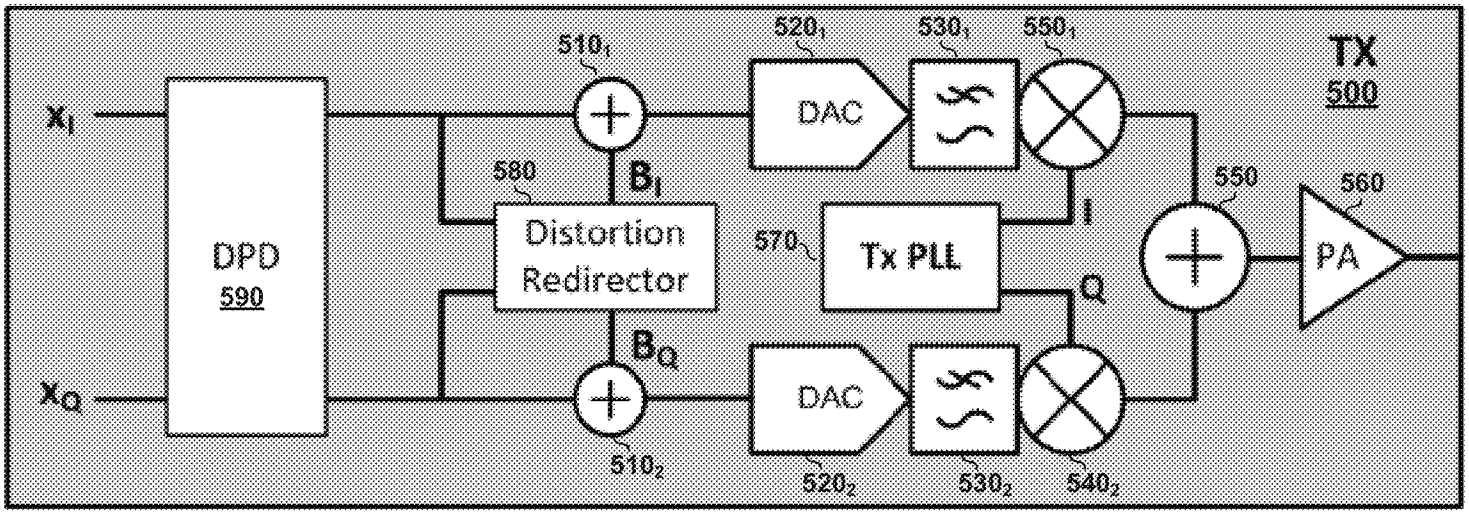
FIG. 5 illustrates another example transmitter that may support distortion redirection, for use in a phased array based system.

FIG. 5 illustrates another example transmitter that may support distortion redirection, for use in a phased array based system. Shown in FIG. 5 is a transmitter circuit 500.

The transmitter circuit 500 may be substantially similar to the transmitter circuit 400, and may operate in a substantially similar manner. In this regard, as with the transmitter circuit 400 of FIG. 4, the transmitter circuit 500 may comprise suitable circuitry for handling processing of signals transmitted via an antenna element in a phased array, and may be additionally configured for supporting use of distortion redirection.

For example, as shown in the example implementation illustrated in FIG. 5, the transmitter circuit 500 may comprise a pair of adders $\mathbf{510}_1$ and $\mathbf{510}_2$, a pair of digital-to-analog converters (DACs) $\mathbf{520}_1$ and $\mathbf{520}_2$, a pair of filters $\mathbf{530}_1$ and $\mathbf{530}_2$, a pair of mixers $\mathbf{540}_1$ and $\mathbf{540}_2$, an adder 550, a power amplifier (PA) 560, a transmit phase-locked loop (PLL) 570 for providing shared timing (periodic) signals, and a distortion redirector 580. Each of these elements may be similar to and may operate in a substantially similar manner as the similarly-named elements in the transmitter circuit 400 of FIG. 4 for example.

However, the transmitter circuit 500 may additionally comprise a digital pre-distortion (DPD) circuit 590, which may comprise suitable circuitry for applying digital pre-distortion, and particularly doing so in an open-loop manner. In this regard, pre-distortion, including digital pre-distortion (DPD), may be used in communication systems to mitigate and/or counteract distortion that may be introduced during communications of signals, such as because of certain characteristics (e.g., nonlinearity) of certain components (e.g., power amplifiers, such as the PA 560) used during communication-related operations. Use of DPD may further improve performance as power amplifiers typically may be the last circuit and/or amplification step in a signal chain, and as such functions (e.g., characteristics thereof) of the power amplifiers may have important effects on signal transmission and quality (e.g., include distortion therein). Accordingly, in the transmitter circuit 500 DPD adjustments, as applied via the DPD circuit 590 to the I/O components (e.g., to signals $X_I$ and $X_Q$), may be combined with the distortion redirection adjustments (as applied by the distortion redirector 580) to allow further enhancement of performance—particularly with respect to reduction of distortion.

Figure 6:
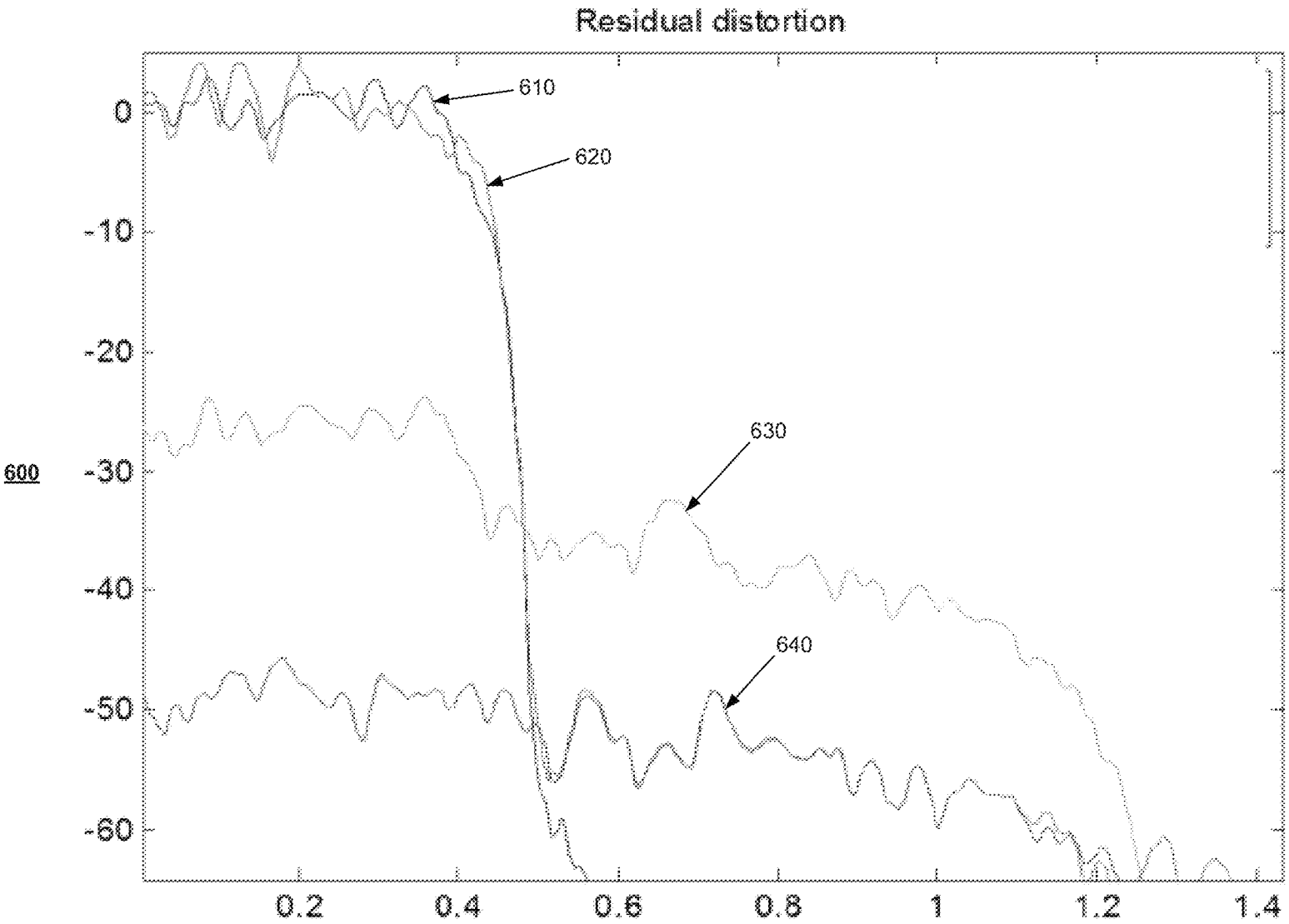
FIG. 6 illustrates a simulation of an example use scenario of a phased array based system that supports distortion redirection.

FIG. 6 illustrates a simulation of an example use scenario of a phased array based system that supports distortion redirection. Shown in FIG. 6 is a power spectral density (PSD) chart 600 corresponding to an example use scenario of a phased array that incorporates use of distortion redirection, as described above for example.

In chart 600, the y-axis represents the antenna power (in dBm) and the x-axis represents the frequency (in multiples of the baseband signal). Shown in chart 600 are graphs 610, 620, 630, and 640, corresponding respectively to the baseband signal, the main signal (beam) of the phased array, the per-element distortion, and phased array overall distortion.

As illustrated in chart 600, use of the distortion redirection results in substantial decrease in overall phased array overall distortion.

Figure 7:
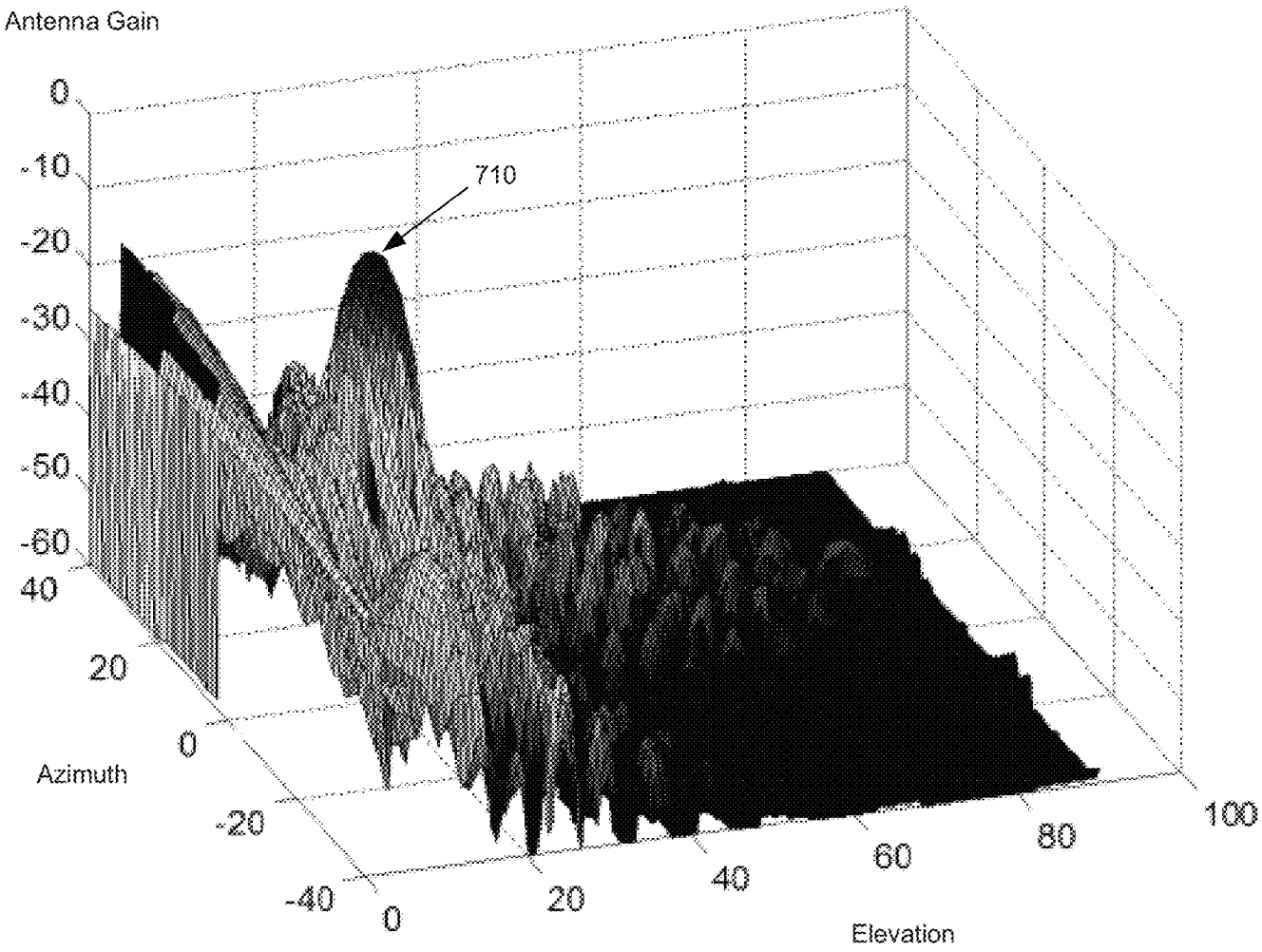
FIG. 7 illustrates an example simulated radiation in a phased array based system that supports distortion redirection.

FIG. 7 illustrates an example of simulated antenna radiation of a phased array based system that supports distortion redirection. Shown in FIG. 7 is a chart 700 illustrating an example simulation-based three dimensional rendition of an antenna pattern for an example phased array based system that supports distortion redirection, implemented in accordance with the present disclosure.

In chart 700, the z-axis represents antenna gain, with the x-axis and y-axis corresponding to elevation and azimuth (both relative to the main direction of the antenna—i.e., with 0 representing the boresight—that is, the direction of the main beam of the antenna), respectively.

As shown in chart 700, use of distortion redirection allows redirecting distortion away from the boresight. For example, with desired signal on the boresight direction, distortion 710 may be directed away from the boresight—e.g., redirected ~20 degrees off boresight as shown in the particular example simulation illustrated in FIG. 7.

Other embodiments in accordance with the present disclosure may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the processes as described herein.

Accordingly, various embodiments in accordance with the present disclosure may be realized in hardware, software, or a combination of hardware and software. The present disclosure may be realized in a centralized fashion in at least one computing system, or in a distributed fashion where different elements are spread across several interconnected computing systems. Any kind of computing system or other apparatus adapted for carrying out the methods described herein is suited. A typical combination of hardware and software may be a general-purpose computing system with a program or other code that, when being loaded and executed, controls the computing system such that it carries out the methods described herein. Another typical implementation may comprise an application specific integrated circuit or chip.

Various embodiments in accordance with the present disclosure may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A method, comprising:

in an electronic device configured for transmission and reception of signals: assessing effects of distortion, corresponding to at least one processing function applied during communication of signals, on the communication of signals, wherein the assessing comprises:

determining one or more characteristics associated with the communication of the signals, wherein the one or more characteristics relate and/or are subject to the effects of the distortion;

assessing the effects of distortion based on the one or more characteristics; and configuring based on the effects of distortion, one or more adjustments for mitigating the effects of distortion, the one or more adjustments including a rotational adjustment; and applying the one or more adjustments during processing of signals.

2. The method of claim 1, wherein the at least one processing function comprise power amplification applied during transmission of signals.

3. The method of claim 1, wherein the one or more characteristics comprise directionality of signals.

4. The method of claim 3, wherein assessing the effects of distortion based on the one or more characteristics comprises determining directionality of interference caused by the distortion in relation to the directionality of signals.

5. The method of claim 4, wherein configuring the one or more adjustments comprises setting or modifying at least one adjustment to adjust the directionality of interference.

6. The method of claim 1, wherein the communication of signals comprises use of a plurality of antenna elements; and wherein configuring the one or more adjustments comprises adaptively setting or modifying at least one adjustment applicable to each antenna element in the plurality of antenna elements.

7. The method of claim 1, comprising configuring the one or more adjustments based on one or more performance criteria.

8. The method of claim 7, wherein the one or more performance criteria comprise enhancing security of the communication of signals; and wherein configuring the one or more adjustments comprises setting or modifying at least one adjustment to reduce detectability of the communication of signals.

9. The method of claim 7, wherein the one or more performance criteria comprise effects on adjacent systems or devices; and wherein configuring the one or more adjustments comprises setting or modifying at least one adjustment to spatially spread interference caused by the distortion.

10. The method of claim 1, comprising configuring and/or applying the one or more adjustments in conjunction with one or more other distortion mitigating measures, the one or more other distortion mitigating measures comprising digital pre-distortion (DPD) based functions.

11. A system, comprising:

a plurality of antenna elements arranged in two-dimensional array; and a plurality of transmitter circuits, each configured for handling transmission of signals via a corresponding antenna element in the plurality of antenna elements, wherein each transmitter circuit comprises:

a distortion control circuit configured to:

assess effects of distortion, corresponding to at least one processing function applied via a processing circuit in transmitter circuit during processing of signals, on communication of signals, wherein the assessing comprises:

determining one or more characteristics associated with the communication of the signals, wherein the one or more characteristics relate and/or are subject to the effects of the distortion;

assessing the effects of distortion based on the one or more characteristics; and configure based on the effects of distortion, one or more adjustments for mitigating the effects of distortion, the one or more adjustments including a rotational adjustment; and one or more adjustment circuits configured for applying the one or more adjustments during the processing of signals via the transmitter circuit.

12. The system of claim 11, wherein the processing circuit comprises a power amplifier.

13. The system of claim 11, wherein the one or more adjustment circuits comprise adders, each adder being configured to add at least one adjustment to a corresponding intermediate signal within the transmitter circuit during processing of the signals.

14. The system of claim 11, wherein the one or more characteristics comprise directionality of signals; and wherein the distortion control circuit is configured to determine directionality of interference caused by the distortion in relation to the directionality of signals.

15. The system of claim 14, wherein the distortion control circuit sets or modifies at least one adjustment to adjust the directionality of interference.

16. The system of claim 11, wherein the distortion control circuit is configured to adaptively set or modify at least one adjustment based on the corresponding antenna element in the plurality of antenna elements.

17. The system of claim 11, wherein the distortion control circuit configures the one or more adjustments based on one or more performance criteria.

18. The system of claim 17, wherein the one or more performance criteria comprise enhancing security of the communication of signals; and wherein the distortion control circuit sets or modifies at least one adjustment to reduce detectability of the communication of signals.

19. The system of claim 17, wherein the one or more performance criteria comprise effects on adjacent systems or devices; and wherein the distortion control circuit sets or modifies at least one adjustment to spatially spread interference caused by the distortion.

20. The system of claim 11, wherein at least one transmitter circuit comprises a digital pre-distortion (DPD) circuit configured for applying digital pre-distortion (DPD) based adjustments in conjunction with the one or more adjustments.

* * * * *